United States Patent [19]

Cox et al.

[11] 4,061,154

[45] Dec. 6, 1977

[54] UMBRELLA WITH INTERCHANGEABLE TOPS

[76] Inventors: James L. Cox, 4604 Arch Court, Orlando, Fla. 32808; Jack M. Pippin, P.O. Box 254, Altamonte Springs, Fla. 32701

[21] Appl. No.: 683,831

[22] Filed: May 6, 1976

[51] Int. Cl.[2] ..... A45B 15/00; A45B 25/18

[52] U.S. Cl. ..... 135/34; 135/36 R; 135/36 F; 135/36 RT

[58] Field of Search ..... 135/34, 36 R, 36 F, 135/36 RT, 36 TP

[56] References Cited

U.S. PATENT DOCUMENTS

| | | | |
|---|---|---|---|
| 530,805 | 12/1894 | Tebow | 135/36 F |
| 1,051,698 | 1/1913 | Daggett | 135/34 X |
| 2,350,227 | 5/1944 | Goldstein | 135/34 |
| 3,000,387 | 9/1961 | Tibony | 135/36 RT |
| 3,534,750 | 10/1970 | Kolozsuary | 135/1 R |

*Primary Examiner*—Reinaldo P. Machado
*Assistant Examiner*—Conrad L. Berman
*Attorney, Agent, or Firm*—Duckworth, Hobby & Allen

[57] ABSTRACT

This invention relates to an umbrella having a centrally located vertical shaft, a plurality of generally equally spaced ribs collapsibly coupled to a top end of the vertical shaft and a detachable cover stretched over the spaced ribs and fastened thereto by cooperating fabric fasteners located at the distended ends of the ribs.

9 Claims, 7 Drawing Figures

UMBRELLA WITH INTERCHANGEABLE TOPS

BACKGROUND OF THE INVENTION

1. Field of the Invention

This invention relates to collapsible umbrellas and in particular to collapsible umbrellas having detachable fabric tops stretched over bowed ribs.

2. Description of the Prior Art

Hand-held personal umbrellas have long been used for protection against the elements and also as fashionable accessories used to compliment or contrast with clothing. Most of the patents representing the umbrella art are directed toward making the hand-held umbrellas more compact when the ribs and cover are not extended. In contrast, little attention has been paid to utilizing new materials and construction methods for producing larger umbrellas, such as those used to provide shade and those used upon the beach. In these designs, the compactness of the umbrella is a secondary consideration when compared to the requirements of durability and freedom from mechanical failure. In particular, these recent advances have not been incorporated into umbrellas specifically designed to operate in adverse environmental conditions, such as exposure to the intense sunlight present in the tropical climates and exposure to salt water and the salt water atmosphere commonly encountered when the umbrellas are used on the beach.

A hand-held collapsible umbrella utilizing a metallic shaft and a rib structure covered by a fabric shield is disclosed by DeWitt in U.S. Pat. No. 992,861. The DeWitt umbrella utilizes a tip cap having a recess therein for restraining the ball ends of the plurality of ribs forming the umbrella frame. Edwards, in U.S. Pat. No. 959,127 discloses a somewhat different method of retaining a ball located at a distended end of the rib structure, within a restraining device. Goldstein, in U.S. Pat. No. 2,350,227 discloses the use of a ferrule accessory for coupling the center section of the fabric top to the tip of the shaft. Dubinsky, in U.S. Pat. No. 3,431,926 and Jones in U.S. Pat No. 2,531,735 illustrate various methods for using sections of the fabric cover for coupling directly to the distended ends of the umbrella ribs. Farkas, in U.S. Pat. No. 2,087,756, discloses the use of U-shaped clips for securing the cover to sections of the ribs intermediate the ends thereof. See also U.S. Pat. No. 2,746,469 issued to D'Andrea, U.S. Pat. No. 940,346 issued to Morton and U.S. Pat. No. 422,643 issued to Shaw.

SUMMARY OF THE INVENTION

This invention relates to an umbrella having interchangeable tops. The umbrella includes a vertical shaft and a plurality of generally equally spaced ribs collapsibly coupled at a first end to the vertical shaft adjacent a top section thereof. A detachable cover is coupled at a central portion thereof to the top end of the vertical shaft. Fabric fastening means are utilized for coupling a distended end of the ribs to a circumferential section of the detachable cover, whereby the detachable cover is stretched over the plurality of ribs and secured thereto by the fabric fastening means.

In a first preferred embodiment of the present invention, the fabric fastening means includes a first VELCRO pad coupled to an underneath side of the distended ends of the ribs, a second VELCRO pad for detachably coupling to the first VELCRO pad for restraining the relative movement therebetween, and a plurality of tabs each attached to but extending radially beyond the circumferential section of the detachable cover for being folded back over the distended end of the ribs, with each of the tabs having the second VELCRO pad coupled thereto.

The present invention is directed toward umbrellas with interchangeable tops of the type suitable for use as personal or beach umbrellas. The umbrella frame elements are constructed of durable plastic materials which can be easily and inexpensively molded, and which will resist the corrosive effects of salt water and a salt water atmosphere. The use of plastic construction materials further enhances the durability of the umbrella in that the ribs and rib support elements will resiliently bend when deformed, rather than irreversibly deforming or breaking, which can often cause a puncture in the fabric top of the umbrella. By extending the life of the umbrella frame, the interchangeable tops may be utilized for a period of time and then replaced at predetermined intervals. Also, the umbrella covers may be designed to communicate specific advertising or commercial messages as required. The use of fabric-type fasteners allows the use of stitching and sewing techniques to couple a non-breakable and non-metallic fastener between the detachable top and the ribs.

THE DRAWINGS

Other objects, features and advantages of the present invention will be apparent from a study of the written description and the drawings in which.

Figures 3, 4, 5, 6, 7:
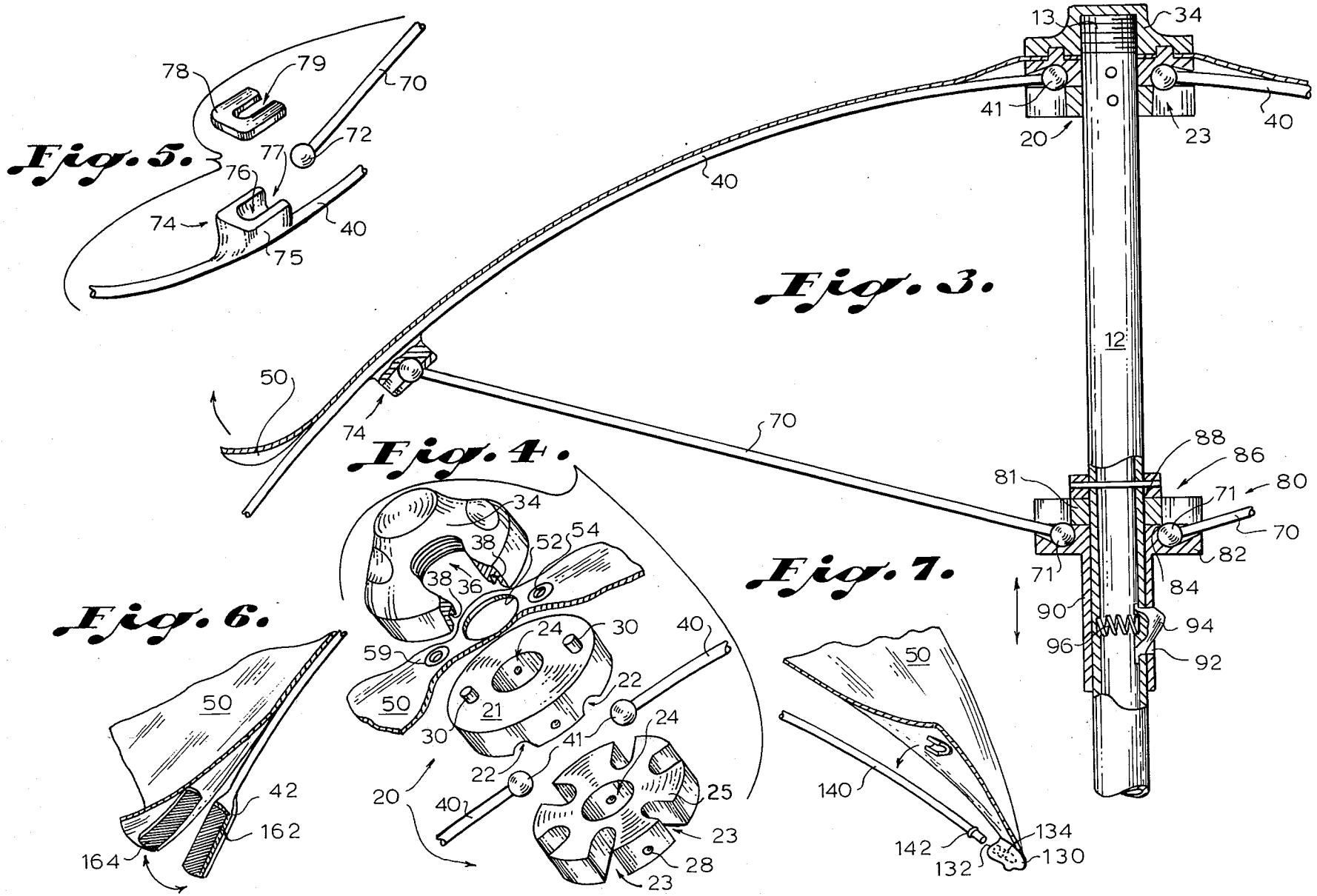
FIG. 3 illustrates a frontal cross-section view of the vertical shaft having the rib supports and ribs coupled thereto.
FIG. 4 is an exploded perspective view of the ferrule and the first and second rib discs.
FIG. 5 is an exploded perspective view of the rib support ball receptacle.
FIG. 6 is a second preferred embodiment of the VELCRO attaching means.

FIG. 7. is a sectional view in partial cutaway showing another embodiment of the fabric coupler of the present invention.

DETAILED DESCRIPTION OF THE PREFERRED EMBODIMENT

Figures 1, 2:
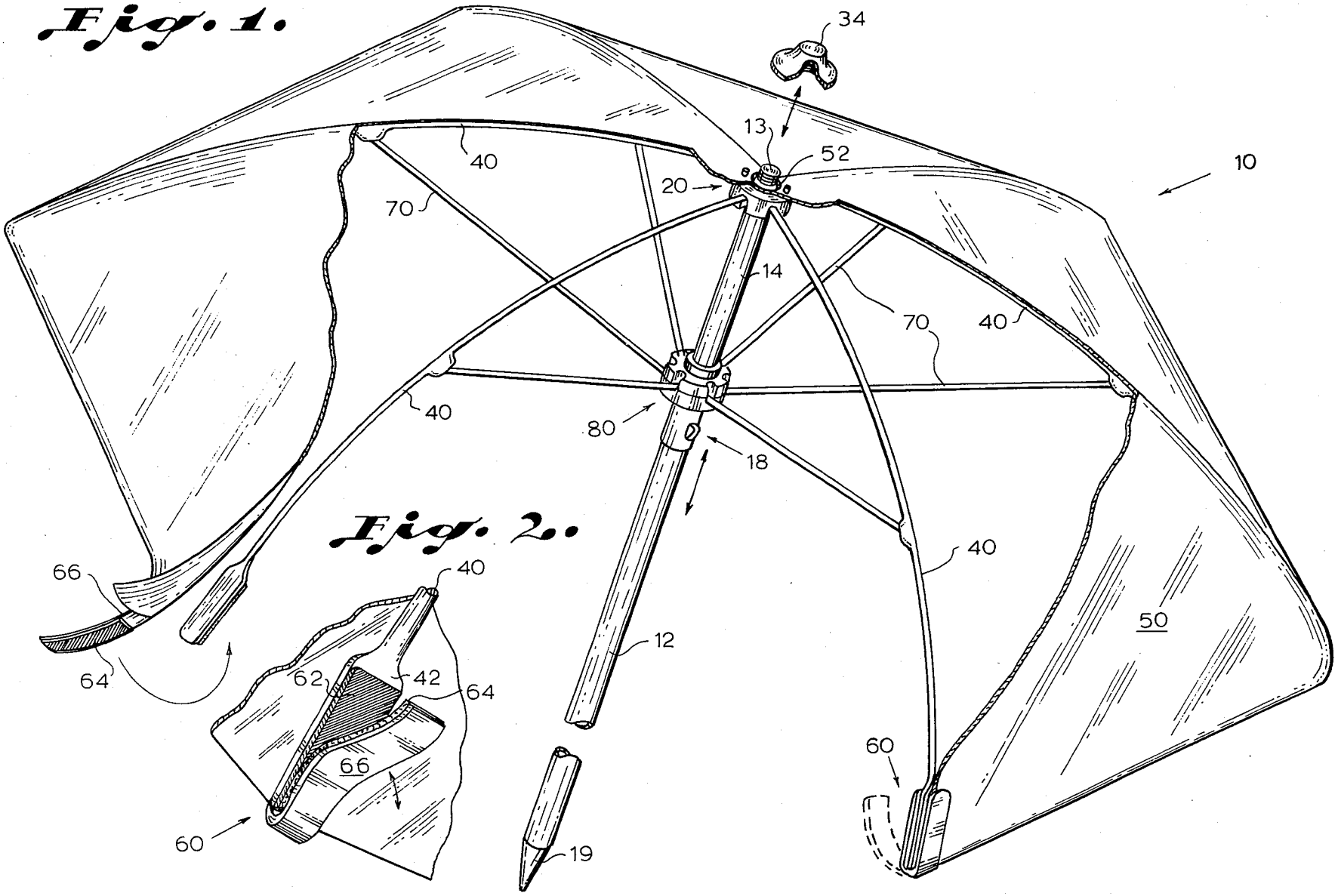
FIG. 1 illustrates a frontal cross-section perspective view of the umbrella.
FIG. 2 illustrates a first preferred embodiment of the VELCRO coupling means.

An umbrella having a detachable top is shown generally as 10 in FIG. 1. The umbrella 10 comprises a vertical shaft 12 having a threaded top end 13, an intermediate section 14, a locking assembly 18, and a pointed or handle end 19. It should be noted that the first preferred embodiment of the present invention is designed for use as a large beach or shade umbrella and therefore the pointed end 19 is necessary for allowing the vertical shaft 12 of the umbrella 10 to be embedded into the sand or ground. However, it will be obvious to one skilled in the art that a curved or cylindrical shaped handle may be substituted at the pointed end 19 for use in a personal sized umbrella.

A rib coupler, shown generally as 20 in FIGS. 1, 3 and 4, comprises a first rib disc 21 and a second rib disc 25 attached coaxially thereto for defining therebetween a plurality of rib ball receptacles 22. These rib ball receptacles 22 are equally spaced about a circle coaxial with the center of the rib discs 21 and 25. Each of these rib ball receptacles 22 comprises a generally spherical void having an outwardly and downwardly extending slot 23 coupled thereto. The first rib disc 21 and the second rib disc 25 each include a central aperture 24 located coaxially therethrough for coupling with the upper end of the vertical shaft 12 adjacent the threaded top end section 13. This coupling may be effected by set screws or pins 28 communicating through the rib coupler 20 and the vertical shaft 12.

A top or upper surface of the first rib disc 21 includes a plurality of circumferentially arranged shafts 30 extending upwardly therefrom. A ferrule 34 includes a central cavity 36 located coaxially therein having a threaded circumferential surface for rotatably coupling with the threaded top end 13 of the vertical shaft 12. A bottom planar surface of the ferrule 34 includes a coaxially located annular channel 38 for receiving therein the plurality of shafts 30 as the ferrule 34 is coupled to the threaded top end 13 of the vertical shaft 12.

A plurality of generally equally spaced ribs 40 are collapsibly coupled to the rib coupler 20 for collapsibly folding about the vertical shaft 12. A first end of each of the ribs 40 includes a rib ball 41 attached thereto. This rib ball 41 is designed to be rotatably restrained within the rib ball receptacle 22 defined within the rib coupler 20. The first end of the rib 40 extends through the slot 23 adjacent to the rib ball receptacle 22. A distended or second end of the rib 40 includes an enlarged pad 42 thereon.

The umbrella 10 further includes a detachable cover 50 formed by sewing together a plurality of wedge-shaped fabric or plastic elements. These elements meet at a central portion thereof for defining a central aperture 52 for coupling with the threaded top end 13 of the vertical shaft 12. As shown in FIG. 4, the central aperture 52 is surrounded by a plurality of reinforced smaller apertures 54 for receiving therethrough the vertical shafts 30 attached to the upper surface of the first rib disc 21. The seams of the detachable cover 50 are generally adjacent to and colinear with the ribs 40. A generally polygonal edge is formed about the circumference of the detachable cover 50 by the second or pad ends 43 of the ribs 40 coupling with the corners of the detachable cover 50. The diameter of the detachable cover 50 is generally equal to twice the length of one of the extended ribs 40.

The circumferential edge sections of the detachable cover 50 are coupled to the pad ends 42 of the ribs 40 by a VELCRO fastening means 60 (or VELCRO coupler or fabric coupler). In the first preferred embodiment as shown in FIGS. 1 and 2, a hooked portion 62 of the VELCRO coupler 60 is fastened to a downward facing section of the pad 42 at the second end of the rib 40. This downward facing section is on a side opposite the section of the pad 42 communicating with the detachable cover 50. A plurality of tabs 66 extend radially beyond the polygonal circumferential edge of the detachable cover 50 for being folded back over the distended ends of the pads 42 at the second end of the rib 40. The inside surface of the tabs 66 each contains an eye or loop portion 64 of the VELCRO coupler 60 for restraining the relative movement between the detachable cover 50 and the rib 40. The tabs 66 may either be sewn to the main section of the detachable cover 50 or may be formed as an integral part thereof by cutting the pologonal shaped detachable cover to a size larger than the supporting ribs and then folding the excess over the pads 42 and back underneath the polygonal edge section of the detachable cover 50. In this manner, the loop portion 64 may be attached to the surface of the cover communicating with the hooked portion 62 of the VELCRO coupler 60. If the tabs 66 are sewn to the circumferential edge of the detachable cover 50, they may be formed of an elastic material for providing a continuous longitudinal biasing force between the hooked portion 62 and the loop portion 64 of the VELCRO coupler 60.

In a second preferred embodiment of the present invention, as shown in FIG. 6, the loop portion 164 of the VELCRO coupler 60 is attached to the inner or downward facing surface of the detachable cover 50 and the hooked portion 162 of the VELCRO coupler 64 is coupled to an upward facing section of the pad 42 at the distended end of the rib 40. In this manner, the VELCRO coupler is located between the upper surface of the pad 42 and the downward facing surface of the detachable cover 50. While this method of attaching the VELCRO coupler 60 is less expensive to produce, it places upon the VELCRO coupler 60 forces other than the preferred longitudinal stretching forces, which may result in one or more of the corners being detached from the corresponding pads 42 when unusually large wind forces are exerted upon the inside or concave surface of the detachable cover 50. Also, this second method of attaching the VELCRO coupler 60 is not as aesthetically pleasing as the first preferred method, since the coupler will produce a somewhat raised or bulging section of the cover 50 adjacent the pad 42. With either of these attaching methods it is preferable to couple the hooked section 62 of the VELCRO coupler 60 to the pad 42 at the distended end of the rib 40 since the hooked portion is the more expensive section of the two. Therefore, the less expensive loop sections 64 may be attached to the detachable cover 50, thereby minimizing the cost of providing a plurality of detachable covers 50 for one umbrella 10. Also, the loop portions 64 of the VELCRO coupler 60 are more adaptable to being sewn to the fabric cover 50 than the hooked portion 62.

The term VELCRO as used herein describes, but should not be limited to, a hook and burr fastening means including a flexible fabric material having two different surfaces (hook and burr, respectively) that, when put together, cooperate with or engage each other for holding the two fabric surfaces together. These two fabric surfaces are generally flexible as compared to the umbrella frame and therefore easily adaptable to being sewn or fastened to deformable or flexible covers such as the detachable cover 50. While the term VELCRO coupler is used herein to describe the means for coupling the detachable cover 50 to the rib pads 42, it is understood that other similar flexible couplers easily adaptable to sewing techniques are intended to be within the scope and spirit of the invention.

A plurality of support ribs 70 are coupled between the intermediate section 14 of the vertical shaft 12 and a section of each of the ribs 40 intermediate between the rib balls 41 and the pads 42. The support ribs 70 provide an outward or bowing force upon each of the ribs 40 for providing a concave shape to the frame of the umbrella 10. A support rib coupler 80, as shown in FIGS. 1 and 3, comprises a first support disc 81 and a second support disc 82 attached coaxially thereto for defining therebetween a plurality of support ball receptacles 84 each having an upwardly and outwardly extending slot 86 coupled thereto. The support rib coupler 80 is generally similar to the rib coupler 20 as shown in FIG. 4, with the following exceptions. First, the slots 86 communicating with the support ball receptacles 84 open in an upward and outward direction. Second, a central aperture 88 located coaxially through the first support disc 81 and the second support disc 82 provides a sliding fit to allow the support rib coupler 80 to communicate longitudinally along the intermediate section 14 of the vertical shaft 12. The second support disc 82 has a cylindrical sleeve 90 depending therefrom which includes an aperture 92 therein. The aperture 92 is adapted to receive a locking button 94 biased into a locking position by the operation of an actuating spring 96. An inward end of each of the support ribs 70 includes a support ball 71 attached thereto for movably communicating within the support ball receptacle 84, thereby allowing the end of the support rib 70 adjacent the support ball 71 to communicate through the slots 86 adjacent thereto.

As shown in FIG. 5, another support ball 72 is coupled to the opposite distended end of the support rib 70 for coupling with a rib support ball receptacle, shown generally as 74. The rib support ball receptacle 74 includes a base section 75 which is coupled on one side thereof to one of the ribs 40. On the opposite side a spherical void 76 and a rib support void 77 are recessed within the base 75 for receiving therein the support ball 72 attached to the distended end of the support rib 70. A top section 78 having a longitudinal access aperture 79 therein is coupled over the spherical void 76 for retaining the support ball 72 therein while allowing the support rib 70 to communicate through the longitudinal access aperture 79.

It is envisioned that the ribs 40, the support ribs 70, the rib coupler 20, and the support rib coupler 80 will be formed of a plastic or resilient material that can be easily and inexpensively produced. The use of a plastic like substance for these critical parts will eliminate the problems caused by corrosion due to the effects of salt water and a salt water atmosphere. Furthermore, the resilient materials will allow the ribs and the support ribs to flex in response to being deformed, such as when the umbrella is overturned. This is to be contrasted with the normal pattern of breakage and corrosion which is encountered when common metals are used. It is also envisioned that the vertical shaft 12 may be fabricated from a plastic or other similar substance. The deformable cover 50 may be formed by sewing together a plurality of generally triangular sheets of fabric, or in the alternative, may be formed from one large polygonal sheet of plastic. Regardless of the material used, the detachable cover 50 must withstand intense solar radiation and exposure to unfavorable elements such as salt water, etc. without appreciable degradation over a period of at least one year. However, since the detachable cover 50 may be easily removed and replaced, it is envisioned that a plurality of covers may be provided for periodic replacement. Also, it is envisioned that advertising messages or fashionably atractive designs may be included upon the detachable cover 50, thereby allowing the owner of the umbrella to frequently vary the appearance as desired.

As shown in FIG. 7, an alternate means for coupling the detachable top 50 to the umbrella frame includes a rib 140 having adjacent a distended end thereof an annular ring 142 coaxially thereon. A plurality of molded sockets 130 are attached by conventional means, such as sewing or adhesive bonding, to the circumference or underneath side of the detachable cover 50. Each of the sockets 130 is paired with a corresponding one of the ribs 140. Each of the sockets 130 includes a recessed cavity 132 for receiving therein the distended end of the rib 140. Furthermore, the cavity 132 includes coaxially therein an annular recess 134 for coupling with and restraining the longitudinal movement of the annular ring 142 attached to the rib 140. The cooperation between the annular ring 142 and the annular recess 134 provides a "snap" action for securing the socket 130 and the removable cover 50 to each of the ribs 140.

It should be understood at this point that the present invention should not be limited in its application to the construction details illustrated in the embodiments shown in the accompanying drawings, since this invention is capable of being constructed in a variety of different methods and of being practiced or constructed in other different embodiments. Also, it must be understood that the terminology and descriptions employed herein are used solely for the purposes of describing the preferred embodiment and should not be construed as limitations on the operability of the invention.

I claim:

1. An umbrella comprising in combination:

a vertical shaft having a top end and a lower end defined at the opposite extremity thereof;

a first rib disc and a second rib disc attached coaxially therewith for defining therebetween a plurality of rib ball receptacles each having a downwardly, outwardly and radially extending slot coupled thereto, with said first and second rib discs each having a central aperture coaxially therein for having said vertical shaft coupled therethrough adjacent said top end thereof;

a plurality of substantially equally spaced ribs each having a rib ball attached to one end thereof for movably coupling within one of said rib ball receptacles, with each of said ribs communicating through one of said radially extending slots for coupling within said first and second rib discs, whereby each of said ribs may collapsibly fold along and be extended from said vertical shaft;

a first support disc and a second support disc juxtaposed coaxially therewith for defining therebetween a plurality of support ball receptacles each having an upwardly and outwardly extending slot coupled thereto, within said first and second support disc each having a central aperture coaxially therein for movably receiving said first vertical shaft therethrough, whereby said first and second support discs move longitudinally along said vertical shaft as said umbrella is collapsibly folded;

a detachable cover coupled at a central portion thereof to said top end of said vertical shaft;

a plurality of support ribs for providing a bowing force on each of said ribs, with a first end of each of said support ribs including thereon a support ball for being movably restrained within one of said support ball receptacles defined by said first and second support discs, a second end of each of said support ribs movably connected to one of said ribs intermediate said end of said ribs;

a detachable cover coupled at a central portion thereof to said top end of said vertical shaft;

a first fabric coupler attached to a distended end of each of said ribs and a second fabric coupler attached to a circumferential edge section of said attachable cover and extending radially beyond said edge section a sufficient dimension to be folded back under said distended end of one of said ribs, each of said first fabric couplers juxtaposed with and removably coupled to one of said second fabric couplers for stretching said detachable cover over said plurality of ribs.

2. The umbrella as described in claim 1 further including a plurality of rib support ball receptacles each coupled to one of said ribs intermediate said ends thereof, said rib support ball receptacle including a base section having recessed in a surface thereof a generally spherical void and a rib support void communicating therewith;

a top section for coupling to said base section for restraining said support ball within said spherical void, with said top section further including a longitudinal axis aperture juxtaposed with said rib support void for allowing said rib support to movably communicate therewith as said rib support is collapsibly folded along said vertical shaft.

3. The umbrella as described in claim 1 wherein said first and second fabric coupler comprises hook and burr fastener pad means said first fastener pad coupled to a downward facing surface of each of said distended ends of said ribs;

said second fastener pad for detachably coupling to said first fastener pad for restraining the relative movement therebetween; and said second fabric coupler including a tab attached to but extending radially beyond said circumferential edge section of said detachable cover for being folded back over said distended end of said ribs, with each of said tabs having said second fastener pad coupled thereto.

4. The umbrella as described in claim 1 wherein said ribs, said rib supports, said first and second rib discs and said first and second support discs are formed from a plastic material.

5. The umbrella as described in claim 1 further comprising a ferrule having a central cavity therein for coupling with a threaded section of said top end of said vertical shaft, with a bottom surface of said ferrule closely communicating with an upper surface of said first rib disc for restraining said detachable cover therebetween.

6. The umbrella as described in claim 5 wherein said detachable cover includes an aperture therein for coupling with said top end of said vertical shaft.

7. The umbrella as described in claim 6 wherein said upper surface of said first rib disc includes a plurality of circumferentially arranged projections extending upwardly therefrom for coupling through a plurality of corresponding apertures within said detachable cover, and wherein said bottom surface of said ferrule includes an annular channel therein for receiving said circumferentially arranged shafts therein.

8. An umbrella comprising in combination:

a vertical shaft;

a plurality of generally equally spaced ribs each collapsibly coupled about a first end thereof to said vertical shaft adjacent a top end thereof;

a detachable cover coupled to a central portion thereof to said top end of said vertical shaft; and a frist fabric coupler attached to a distended end of each of said ribs and a second fabric coupler paired therewith and attached to a circumferential section of said detachable cover, with each of said first fabric couplers juxtaposed with and removably coupled to one of said fabric couplers for stretching said detachable cover over said plurality of ribs, said first fabric coupler comprising a first fastener pad coupled to said downward facing surface of said distended end of each of said ribs;

said second fabric coupler comprising a second fastener pad for detachably coupling to said fastener first pad for restraining the relative movement therebetween; said first and second fastener pads including hook and burr fastener means has been inserted.

a plurality of tabs each attached to but extending radially beyond said circumferential section of said detachable cover for being folded back under said distended end of each of said ribs, with each of said tabs having said second fastener pad attached thereto.

9. The umbrella as described in claim 8 wherein each of said tabs are formed of an elastic material for providing a biasing force between said first and said fastener pads.

* * * * *